United States Patent [19]

Honig

[11] 3,978,553

[45] Sept. 7, 1976

[54] NAPKIN

[75] Inventor: Edith M. Honig, Miami Beach, Fla.

[73] Assignee: Lawrence Peska Associates, Inc., New York, N.Y. ; a part interest

[22] Filed: Feb. 6, 1976

[21] Appl. No.: 655,709

[52] U.S. Cl. ..... 24/7; 24/3 F; 150/52 C; 206/216

[51] Int. Cl.[2] ..... A45F 5/04

[58] Field of Search ..... 24/7, 3 F; 150/52 C, 150/52 R; 206/216

[56] References Cited

UNITED STATES PATENTS

| | | | |
|---|---|---|---|
| 2,218,892 | 10/1940 | Ratzlaff | 150/52 C |
| 2,247,320 | 6/1941 | Stanley | 150/52 R |

*Primary Examiner*—Bernard A. Gelak

[57] ABSTRACT

A napkin that is especially adapted to remain on the lap of the user during the eating operation and additionally provides for a pocket to hold silverware such as for use on airplanes, trains and the like.

5 Claims, 3 Drawing Figures

NAPKIN

BACKGROUND OF THE INVENTION

This invention relates to napkins; more particularly to napkins that will not slide off of one's lap and to a further embodiment that incorporates a pocket or flap in the napkin to hold silverware.

The prior art teaches a variety of differing napkins, for example, as disclosed in U.S. Pat. Nos. 1,864,281; 2,009,831; 2,902,734; 3,398,439; 3,654,059; 3,675,274; and others. None of the foregoing, however, provide for a napkin that is completely self contained, that is already having the adhesive means thereon and additionally providing for means to retain flatware prior to its being needed; such as in airplanes, trains and the like.

SUMMARY OF THE INVENTION

It is accordingly an object of the instant invention to provide for a new and improved napkin.

It is another object to accomplish the aforementioned goals.

It is a further object to provide for the same at relatively little cost thereby making it generally available.

These and other objects and advantages of the invention will become more apparent from the following detailed disclosure and claims and by reference to the accompanying, drawings, in which:

Figure 1:
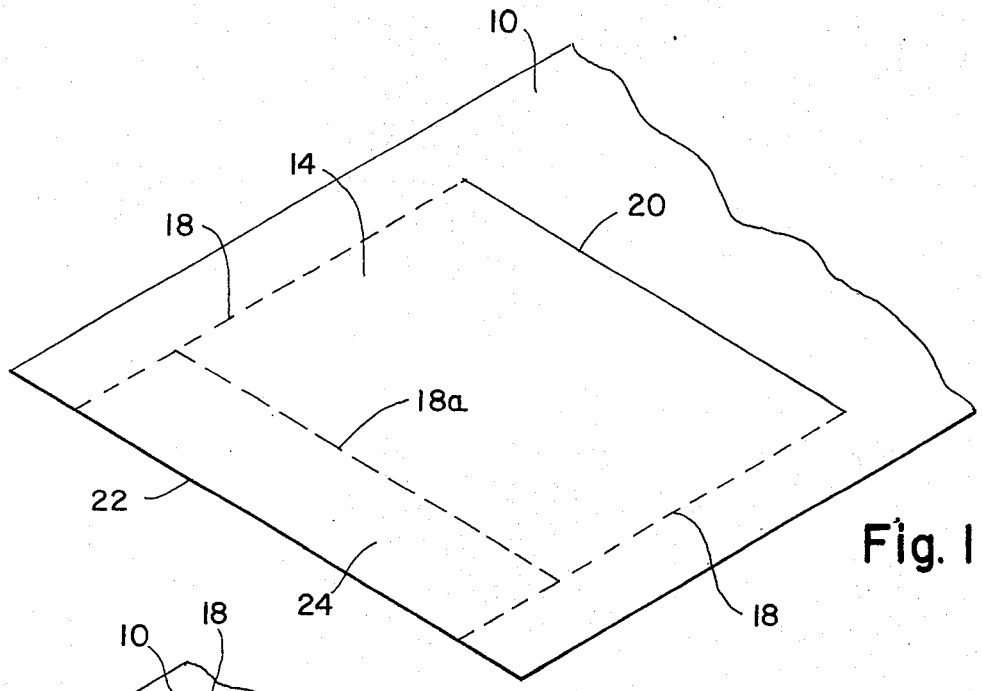
FIG. 1 is a top plan view.
Figure 3:
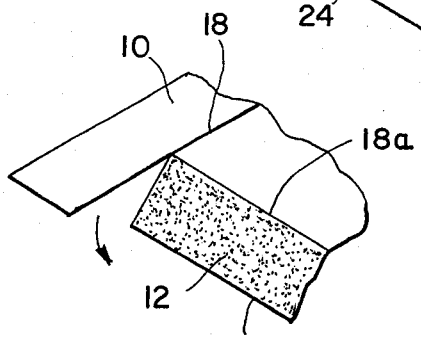
FIG. 3 is a detailed view of a section of FIG. 2.
Figure 2:
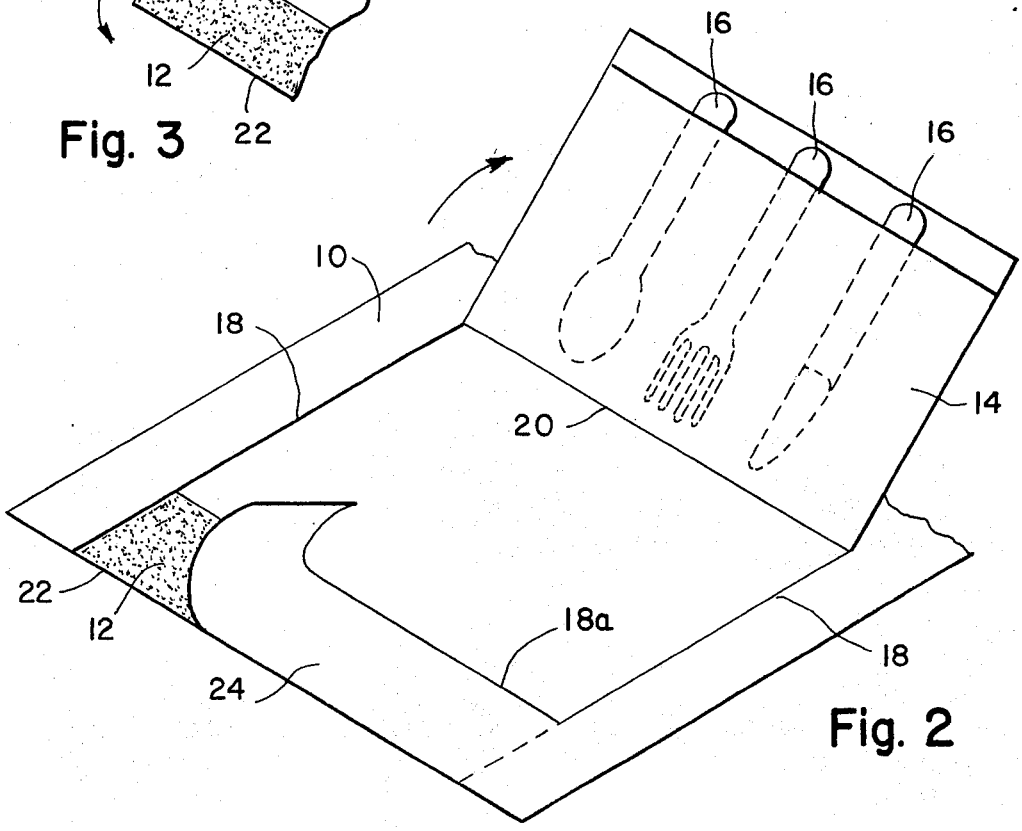
FIG. 2 is a perspective view.

Broadly speaking- the instant invention includes the provision of a napkin especially adapted to be adhesively retained on the clothing of the user, comprising a first sheet of pliable material, the first sheet having a border defining a substantially centrally disposed flap section, the flap section including at least two layers of opposing second sheets joined on at least three sides and forming a pocket therebetween, the pocket adapted to releasably retain a quantity of flatware therein, the three sides being in contact with and coforming the border, the three sides being joined to said first sheet along the border by a perforated line, the line adapted to be broken whereby the flap may be lifted upward away from the first sheet, pressure sensitive adhesive means disposed along one lateral end of the first sheet, cover means on the adhesive to be removed therefrom to expose the adhesive layer, the adhesive layer being adjacent one end of the flap.

DETAILED DISCLOSURE

Referring more particularly to the drawings, there is shown a substantially planar, flexible deformable sheet 10 that may be any desired shape. The sheet 10 may be made from paper, woven or non-woven materials, plastic or the like as is customary in the napkin trade. The sheet 10 will define a bordered area within the perimeter thereof that includes the adhesive means 12 and the pocket or flap 14 for retaining the flatware 16. Within the bordered area there is at least a two ply layer that includes the sheet 10 itself and the layer 14 that forms the flap. The sheet 10, if desired, may be greater than one ply. The flap 14 is therefore disposed substantially centrally within the confines of the sheet 10. It is formed by providing for a perforated line 18 along at least three sides thereof. The fourth side, will merely define a fold line 20, such that the flap 14 is adapted to lift upward away from the sheet 10 at that line 20. The flap 14 is preferably formed of two opposing sheets, joined at there common base at the fold line 20, such that there is formed a pocket therebetween to retain the flatware 16.

Disposed along one lateral end 22 of the sheet 10, preferably at the end opposite the fold line 20, there will be a layer of pressure sensitive adhesive 12, adapted to contact the lap of the wearer. The adhesive 12 will preferably not be disposed end to end to the sides of the sheet 10 transverse the adhesive containing end 22, but rather fall short thereof, such that the sheet 10 may be more easily handled. The distal ends of the border for the flap 14 will generally define the length of the adhesive side 22. A peel off cover portion 24 will also be provided for covering of the adhesive containing end 22. The portion 24, may if desired be treated with a self release coating or be constructed of a self release material such as plastic or the like.

If desired, the adhesive containing end 22, may be folded backward along a fold line **18*a* that is defined by the end from where the flap 14 was pulled upward away from the sheet 10.**

The pressure sensitive adhesive 12, the perforated line 18, the fold lines **18*a* and 20** as well as the method of application thereof to the sheet are all well known in the art, in and of themselves and need not be detailed further herein.

Since it is obvious that numerous changes and modifications can be made in the above-described details without departing from the spirit and nature of the invention, it is to be understood that all such changes and modifications are included within the scope of the invention.

I claim:

1. A napkin especially adapted to be adhesively retained on the clothing of the user, comprising a first sheet of pliable material, said first sheet having a border defining a substantially centrally disposed flap section, said flap section including at least two layers of opposing second sheets joined on at least three sides and forming a pocket therebetween, said pocket adapted to releasably retain a quantity of flatware therein, said three sides being in contact with and coforming said border, said three sides being joined to said first sheet along said border by a perforated line, said line adapted to be broken whereby said flap may be lifted upward away from the first sheet, pressure sensitive adhesive means disposed along one lateral end of said first sheet, cover means on said adhesive adapted to be removed therefrom to expose said adhesive layer, said adhesive layer being adjacent one end of said flap.

2. The napkin as defined in claim 1 wherein said flap is constructed of a plastic material.

3. The napkin as defined in claim 1 wherein said first sheet is liquid absorbent.

4. The napkin as defined in claim 1 wherein all of said sheets are constructed of the same material.

5. The napkin as defined in claim 1 wherein said adhesive layer is defined by said border and one end of said flap.

* * * * *